US011168957B2

(12) United States Patent
Cass

(10) Patent No.: US 11,168,957 B2
(45) Date of Patent: Nov. 9, 2021

(54) HOLSTER FOR ASSAULT RIFLE

(71) Applicant: Joseph Allen Cass, Spotsylvania, VA (US)

(72) Inventor: Joseph Allen Cass, Spotsylvania, VA (US)

( * ) Notice: Subject to any disclaimer, the term of this patent is extended or adjusted under 35 U.S.C. 154(b) by 0 days.

(21) Appl. No.: 16/602,961

(22) Filed: Jan. 6, 2020

(65) Prior Publication Data

US 2021/0207922 A1 Jul. 8, 2021

(51) Int. Cl.
*F41C 33/00* (2006.01)
*F41C 33/04* (2006.01)
*F41C 33/02* (2006.01)

(52) U.S. Cl.
CPC ..... *F41C 33/007* (2013.01); *F41C 33/0245* (2013.01); *F41C 33/045* (2013.01); *F41C 33/046* (2013.01)

(58) Field of Classification Search
CPC .. F41C 33/007; F41C 33/0245; F41C 33/045; F41C 33/046; B60R 7/14
USPC ..... 224/247
See application file for complete search history.

(56) References Cited

U.S. PATENT DOCUMENTS 3,348,746 A * 10/1967 Stumpf ..... A41D 13/0012 2/94
10,144,358 B2 * 12/2018 Fife ..... B60R 7/043
10,466,011 B2 * 11/2019 Swan ..... F41C 33/0263
2013/0146628 A1 * 6/2013 Gump ..... F41C 33/0236 224/257
2013/0305580 A1 * 11/2013 Burress, Jr. ..... F41C 23/22 42/71.01
2014/0190054 A1 * 7/2014 Ascano ..... F41C 33/007 42/71.01
2016/0202017 A1 * 7/2016 Corbet ..... B25G 1/102 42/71.01
2018/0195833 A1 * 7/2018 Bentley ..... F41C 23/10

* cited by examiner

*Primary Examiner* — Corey N Skurdal
(74) *Attorney, Agent, or Firm* — Patent Law of Virginia, PLLC; Brian J. Teague

(57) ABSTRACT

A holster is disclosed specially adapted for a long weapon, the long weapon having a pistol grip and a magwell. The holster comprises two separate brackets, an upper bracket and a lower bracket, where both the upper and lower holster brackets are adapted to be supported by a tactical vest with moly webbing. The upper holster bracket is U-shaped and snaps over the pistol grip of the long weapon. A detent is located on the inner surfaces of the U-shaped bracket which engages a channel located on the faces of the pistol grip.

In another embodiment a post is attached to the holster that is adapted to engage a corresponding hole through the pistol grip of a weapon. The post has a spherical knob on the end opposite the holster wherein the knob snaps into a corresponding enlarged spherical section of the hole located through the pistol grip. A snap element including a spring biased button is embedded into the pistol grip wherein the snap element releasable engages the hemispherical bulb of the post.

4 Claims, 14 Drawing Sheets

HOLSTER FOR ASSAULT RIFLE

CONTINUING DATA

This application is a continuation in part of U.S. application Ser. No. 16/501,212 filed Mar. 18, 2019.

FIELD OF THE INVENTION

The present invention is directed to a holster adapted to safely hold a long type weapon, such as an assault type weapon, upon the forward torso of a user. The holster securely affixes the weapon to the body of the user in a position where it can be accessed rapidly while at the same time being immobilized. The holster affords the user the ability to store the weapon in a position where it is rapidly deployable while maintaining both hands free.

BACKGROUND OF THE INVENTION

Long weapons such as rifles, shotguns, or assault weapons are commonly carried by both law enforcement in the performance of their civilian duty and by the military in armed combat situations. Although the specification refers to assault type weapons, this is by way of example. The invention is equally applicable to any long type weapon such as a rifle, shotgun, or assault type weapon.

Because of the length and size of long type weapons, as exemplified by the Colt M-16 or M-16 clones, an unholstered weapon requires the dedication of at least one hand at all times to maintain control of the weapon. This encumbers a soldier or law enforcement officer by restricting their movements to one hand in emergency situations. Frequently two hands are required under emergency or combat scenarios, which cannot be accomplished when one hand is dedicated to maintaining control of the long weapon. There exists a need for a holster to securely and safely hold the long weapon on the person of the soldier or law enforcement officer, while enabling rapid deployment of the weapon. Similarly when any long weapon is carried in civilian use the invention frees both of the users hands when the weapon is secured in the holster.

SUMMARY OF THE INVENTION

The instant invention provides a two-piece attachment comprising an upper bracket and a lower bracket for attachment to conventional tactical vests of the type worn by military personnel or law enforcement officers. The upper bracket of the holster readily slides over one of the belts that are commonly provided with tactical vests. These belts are referred to as moly-webbing or moly-strapping and are universally one-inch in width. Although the standard moly-webbing width is one-inch it is expressly understood that the invention is adaptable to webbing of any material or width. This upper bracket of the holster is specifically adapted to removably attach to the pistol grip of the weapon. The lower bracket of the holster slides over another, preferably lower moly-webbing of the tactical vest and removably attaches to the lower front and side faces of the weapon's magwell. Both the upper bracket and the lower bracket can be oriented at various positions on the moly-webbing to accommodate the user's personal preference and comfort. When secured to the user's body in this way the weapon is securely affixed to the user's body and crosses his torso with the muzzle pointing downward in a safe fashion. When the weapon is being retrieved from the holster, the pistol grip is close to the normal operating position assumed when the weapon is being fired. The user is able to quickly remove the weapon from the holster and be in a ready to fire position nearly simultaneously.

Because the weapon is securely attached to the holster, the law enforcement officer or soldier has two hands free, providing a substantial tactical advantage to the user. The holster can be employed when the user is in a seated, or standing position. In use it has been found that the weapon remains secure even when the user encounters an accidental or deliberate fall, rolls, or drops to a safe position whenever necessary depending on conditions.

DETAILED DESCRIPTION OF PREFERRED EMBODIMENTS

According to the instant invention a holster is disclosed that is specially adapted to securely affix a long weapon to the front torso of a user. The holster is designed to attach to a conventional tactical vest with belts, normally moly-webbing or moly-strapping. The holster comprises two pieces, an upper holster bracket and a lower holster bracket. The upper holster bracket is attached to moly webbing on the tactical vest and is specifically shaped to snap over the pistol grip of a weapon, such as a Colt M-16 or an M-16 clone. Although Colt M-16 type weapons are describe herein, it is expressly understood that the invention is not limited to any particular weapon. The lower holster bracket also attaches to moly webbing located on a conventional tactical vest, preferably a lower moly webbing of the vest. The lower holster bracket snaps over the magwell of the weapon.

Figure 1:
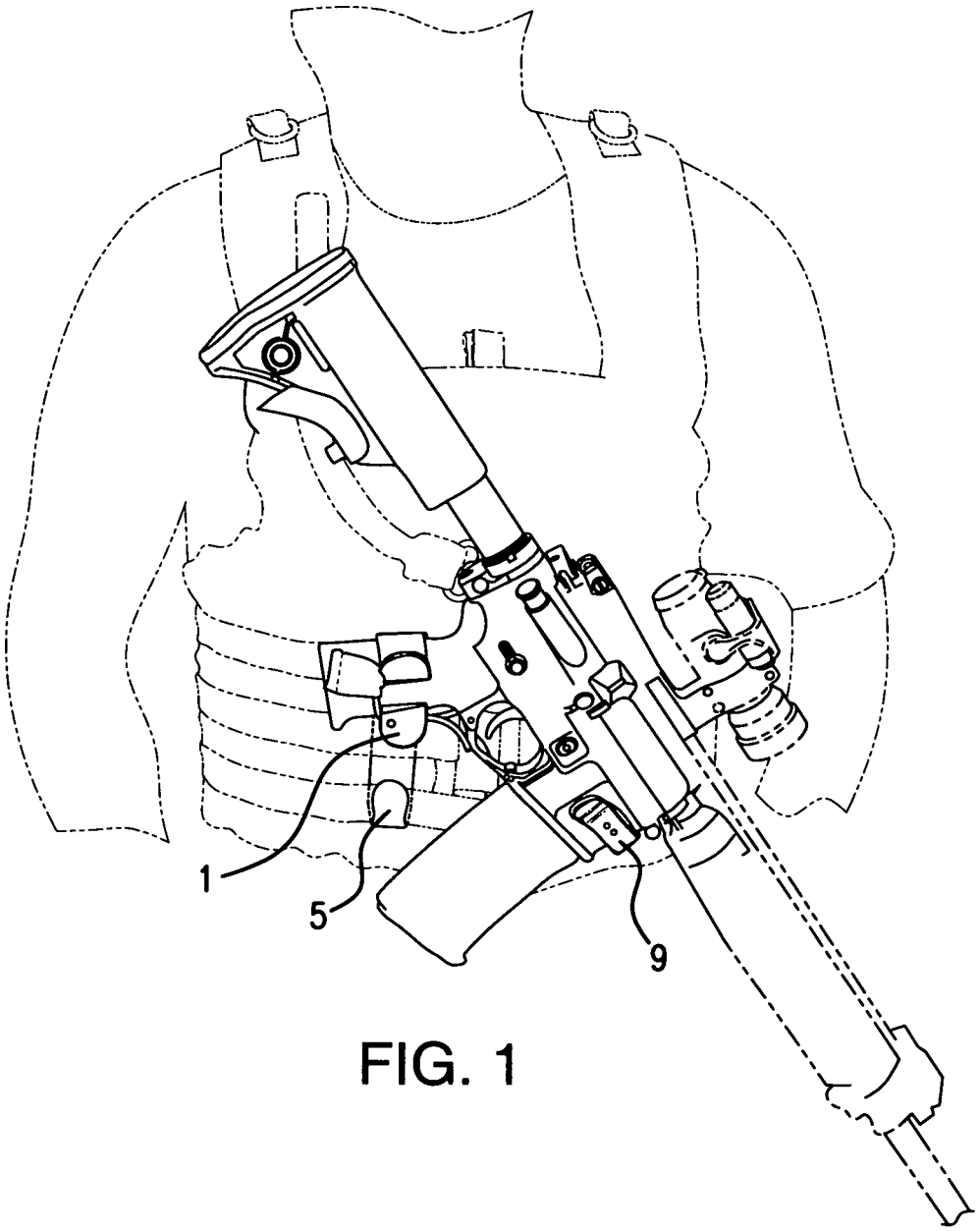
FIG. 1 shows the holster according to the invention, attached to a tactical vest worn by an armed user, with an assault rifle secured to the tactical vest.

FIG. 1 shows the combination of a tactical vest with the upper and lower holster brackets attached to the vest. FIG. 1 additionally shows an assault weapon holstered by the holster of the invention and being worn by a user in a combat ready position. Upper holster bracket (1) secures the pistol grip of the assault weapon and lower holster bracket (9) secures the magwell of the assault weapon. As can readily be seen, the muzzle safely points downward towards the ground.

Figure 2:
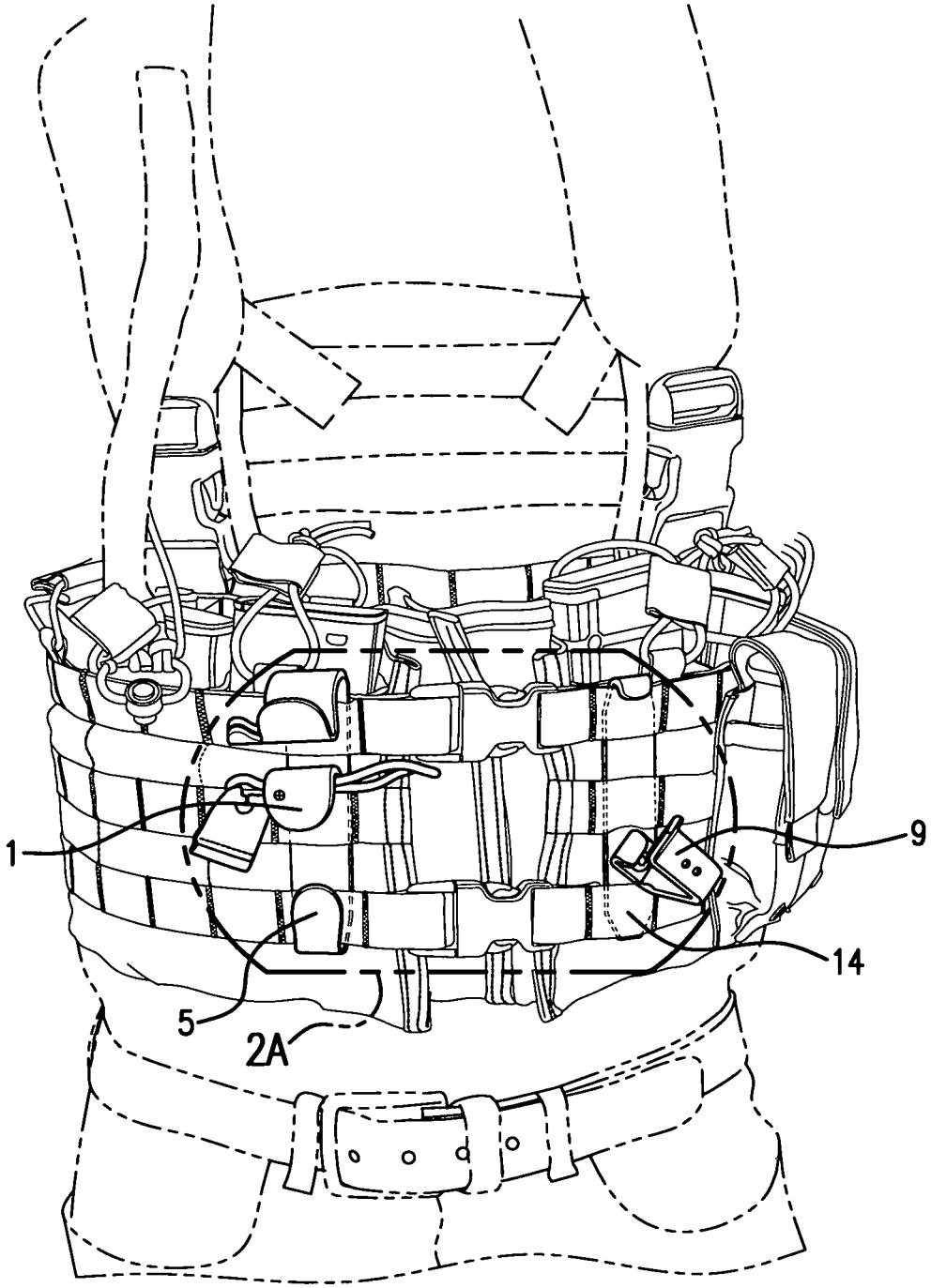
FIG. 2 shows the holster according to the invention attached to a tactical vest with no assault rifle holstered to the tactical vest.
Figure 2A:
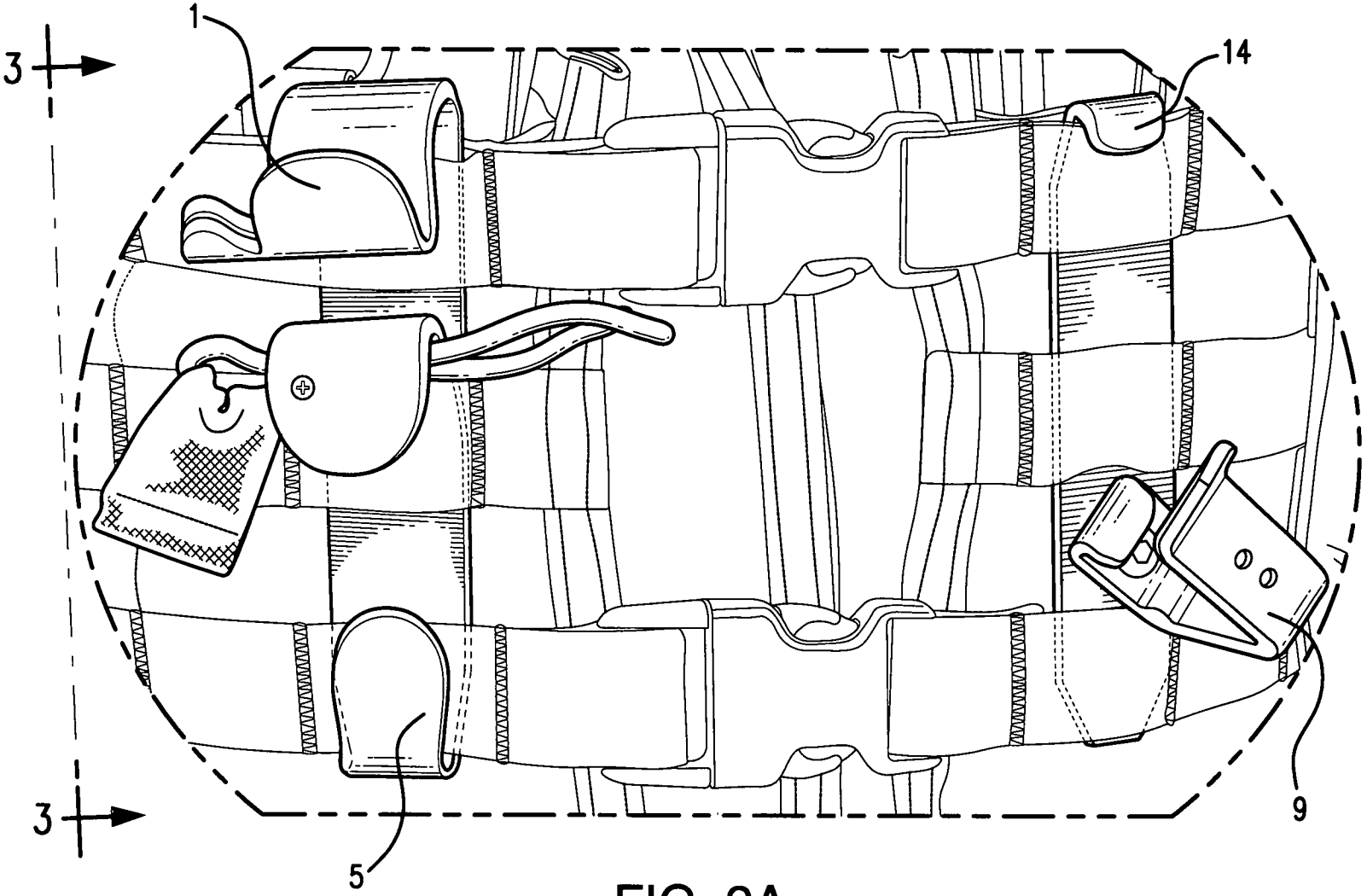
FIG. 2A is an enlargement of the structure defined by the broken line of FIG. 2.

FIG. 2 shows the holster as it appears attached to a tactical vest with no firearm attached. Upper holster bracket (1) is secured to moly web on a tactical vest. Lower holster bracket (9) is secured to moly web that is located at a position below upper holster bracket (1). It can be seen that gravity assists in keeping the weapon in place when the user is in a standing, combat ready position, because of the orientation of the upper holster bracket (1) relative to the lower bracket (9) of the holster.

Figure 3:
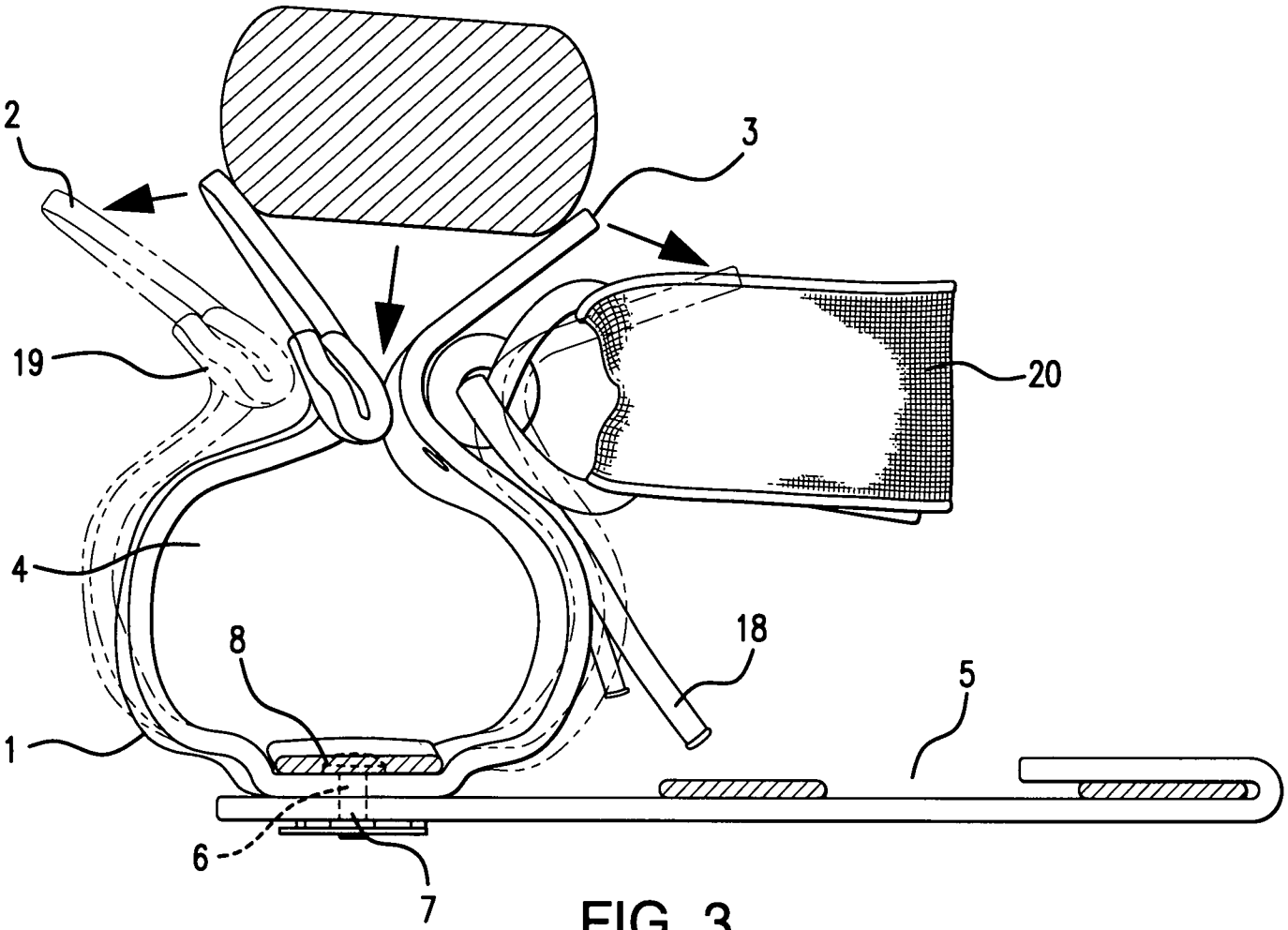
FIG. 3 shows the upper bracket of the holster with the pistol grip of an assault rifle aligned and ready to secure the assault rifle within the upper bracket.
Figure 4:
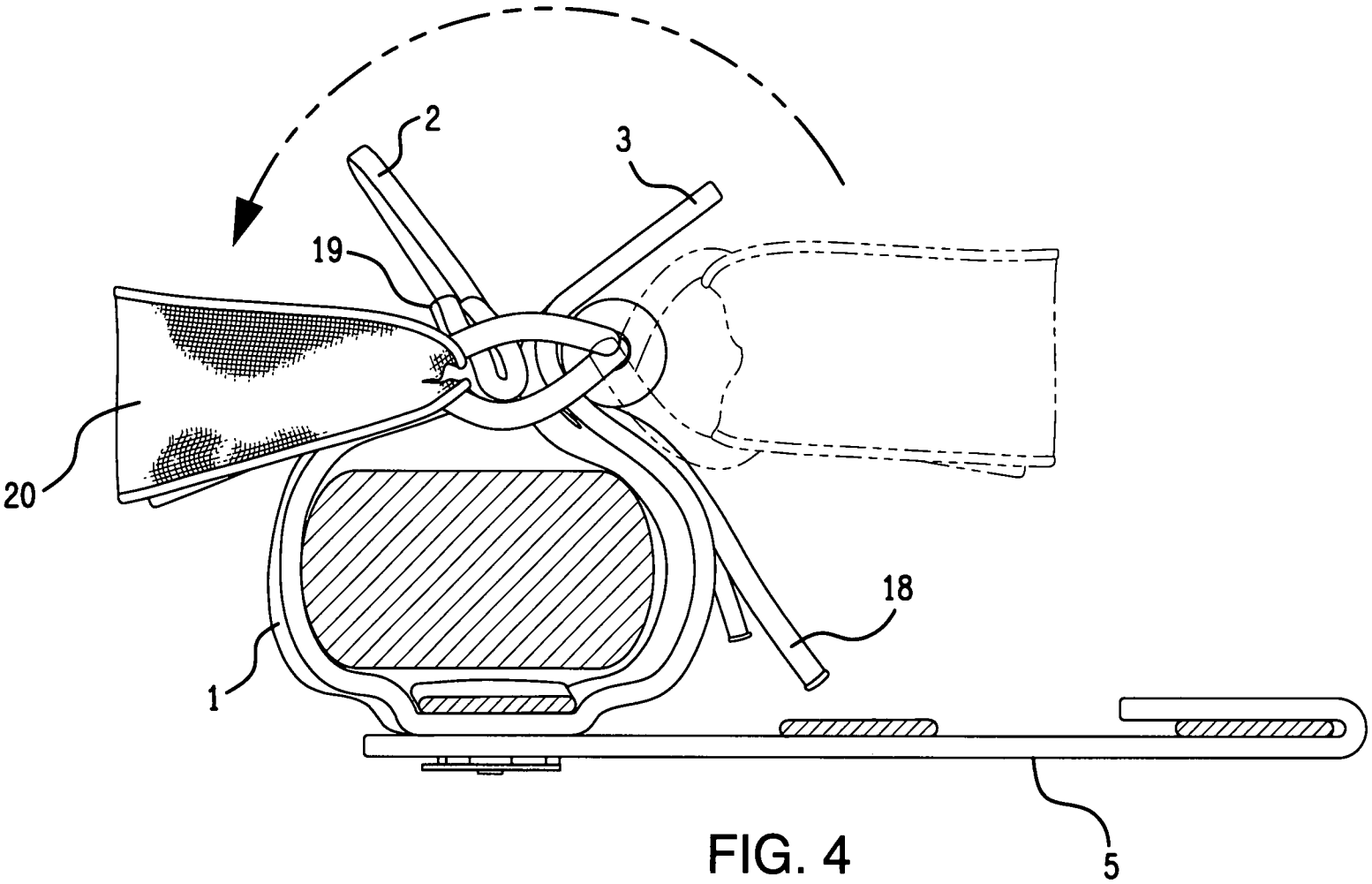
FIG. 4 shows the upper bracket of the holster of FIG. 3 with the pistol grip of an assault rifle secured by the upper bracket.

Referring to FIGS. 3 and 4, a single blank piece of thermoplastic with two terminal ends is used to form the upper bracket (1) of the holster. Wings (2) and (3) are thermoformed from the two terminal ends of the thermoplastic blank in a partial retrograde fashion to fold away from and oppose each other in the manner shown. Upper holster bracket (1) is formed from a somewhat flexible, but renitent thermoplastic. Wings (2) and (3) are manually spread apart in order to accept and surround the pistol grip of an assault weapon. Kydex®, an acrylic-polyvinyl chloride is a preferred material. By spreading wings (2) and (3) apart, upper holster bracket (1) opens up wide enough to receive the pistol grip of the assault weapon inside of the somewhat elliptical space (4) defined by the upper bracket (1) of the holster. FIG. 4 shows upper holster bracket (1) with the pistol grip of an assault weapon in place. After receiving the pistol grip of the assault weapon in space (4), wings (2) and (3) rebound to their initial shape providing a secure interference fit with the pistol grip of the assault weapon. Of course the force necessary to spread wings (2) and (3) apart must be small enough to allow a user to easily spread the wings (2) and (3) apart using finger pressure while maintaining sufficient compressive force on the weapon's pistol grip to securely affix the weapon to the torso of the user. An upper rigid moly web fastener (5) is connected to upper holster bracket (1) with a screw, rivet, or other suitable fastener (8). The fastener extends through hole (6) located through the upper holster bracket (1) and through hole (7) located on moly web fastener (5). Holes (6) and (7) register to enable attachment with the fastener (8). Any fastener that allows rotation of upper holster bracket (1) about upper moly web fastener (5) while securely affixing upper holster bracket (1) to upper moly web fastener (5) is suitable to the practice of the invention.

The rigid moly web fastener (5) is formed from a one-piece thermoplastic blank with two terminal ends, distal and proximal. The distal end is thermoformed to attach to a moly web on the tactical vest, preferably an upper moly web. Rigid upper moly web fastener (5) is folded at the distal end 180 degrees in retrograde forming a slot adapted to slide over the top of a moly web located on the tactical vest. It is important that the distal end of attachment member (5) be folded enough to provide a tight interference fit with the moly web on the tactical vest to securely affix upper bracket (1) of the holster to the moly web. Upper holster bracket (1) is rotatably attached to the proximal end of rigid moly web fastener (5) with fastener (8) enabling upper holster bracket (1) to rotate freely about rigid moly web fastener (5). The rotatable feature of the upper bracket (1) about the moly web fastener (5) aids in keeping the assault weapon in place. When the user is in motion, gravity assists in keeping the assault weapon properly orientated.

FIGS. 3 and 4 show as elastic cord used to additionally secure an assault weapon to upper holster bracket (1). FIG. 3 shows elastic cord (18) before an assault weapon is holstered. Elastic cord (18) forms a closed loop and is affixed to one wing of upper holster bracket (1). A detent (19) is located on the opposite wing of upper holster bracket (1). Elastic cord (18) is secured to the wing facing detent (19) such that elastic cord (18) can be stretched and hooked to detent (19), securely affixing the assault weapon into the holster, as shown in FIG. 4. Elastic cord (18) secures the assault weapon until the user releases elastic cord (18). Tab (20) comprises a ribbon or equivalent woven or nonwoven sheet to facilitate finger contact with the elastic cord even when the user is wearing gloves. It is understood that detent (19) could be provided on either side or both sides of upper holster bracket (1) thereby enabling easy ambidextrous operation.

Figure 5:
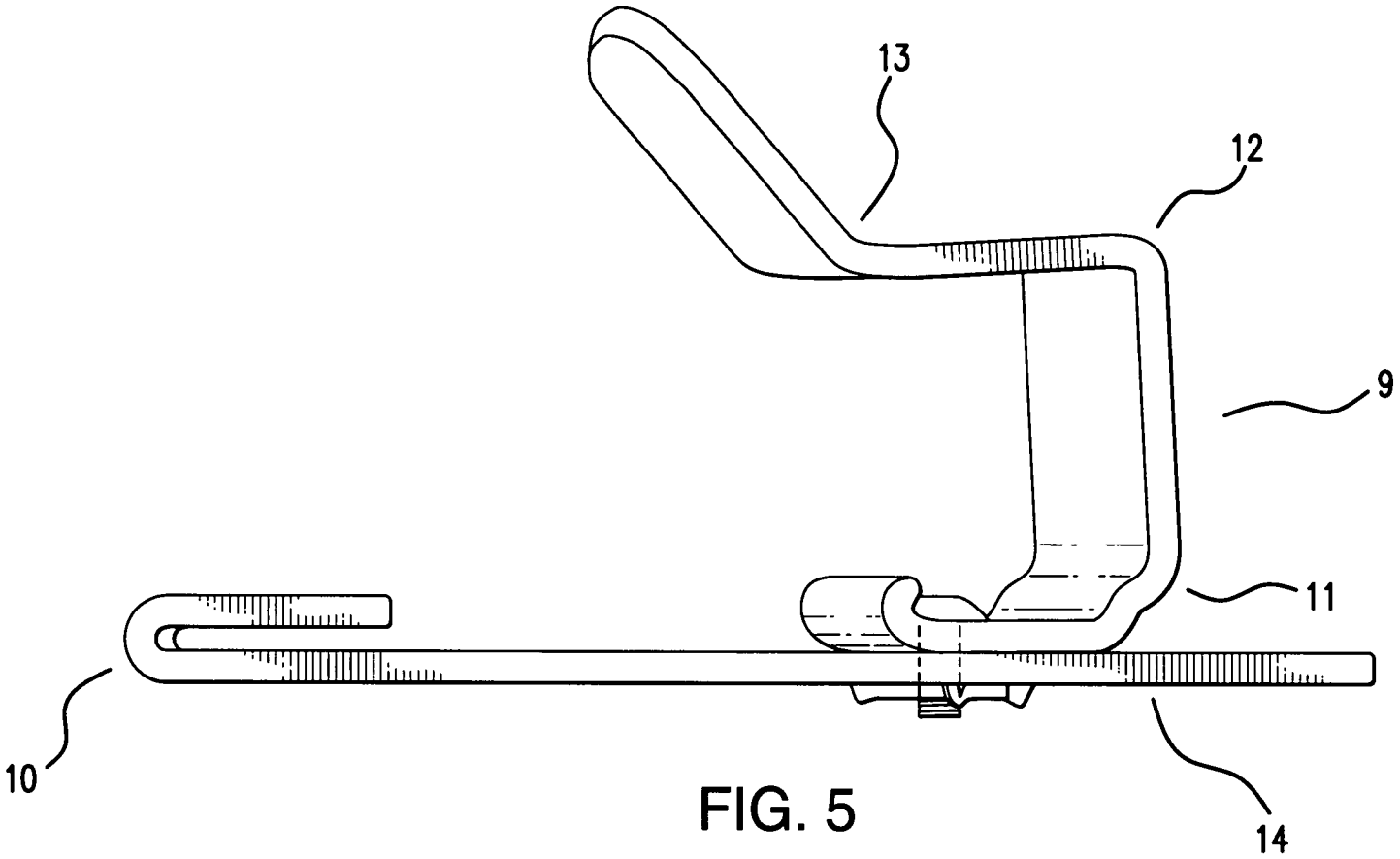
FIG. 5 shows the side view of the lower bracket of the instant holster separate from the tactical vest.

FIG. 5 shows the lower holster bracket (9) that is adapted to engage the magwell of an assault weapon. Similar to upper holster bracket (1) lower holster bracket (9) is adapted to slide over moly web located on a tactical vest. Lower holster bracket (9) is located below upper holster bracket (1) to maintain the muzzle of the assault weapon pointing downwards toward the ground when a user is in a standing position. This ensures that an accidental discharge of the assault weapon is more likely to harmlessly strike the ground. Lower holster bracket (9) includes a lower moly web fastener (14) rotatably screwed to the lower holster bracket (9). Lower holster attachment member (14) is preferably made from a suitable thermoplastic blank. The thermoplastic blank is folded 180 degrees in complete retrograde at the distal end as seen at (10) to form an open loop that slides over the top of the moly web of a tactical vest. It is important that fold (10) be dimensioned such that fold (10) provides an adequate interference fit with the tactical vest moly web to maintain the long weapon securely against the user's torso. At the proximal end of lower moly web fastener (14) another 180 degree fold in complete retrograde may optionally be included to provide a secure attachment to the lower portion of the tactical vest moly web. Lower holster bracket (9) is roughly "U" shaped to accept the magwell of an assault rifle. Lower holster bracket (9) is formed preferably from a one-piece thermoplastic blank, having a distal end that attaches to the moly web fastener (14) and a proximal end facing outward from the tactical vest. The blank is sequentially folded to form a bend (11) at the distal end of blank (9). Bend (11) is approximately 90 degrees relative to the unfolded portion of the blank where holster bracket (9) is adapted to attach to moly webbing fastener (14), thereby abutting moly web fastener (14) at approximately a perpendicular. The blank is then folded again approximately 90 degrees relative to the bend at (11) to form bend (12), thereby forming a length of lower holster bracket (9) that is approximately parallel to upper moly web fastener (14). Bends (11) and (12) together form a somewhat "U" shaped slot adapted to receive the mag well of an assault rifle. Lower holster bracket (9) is finally folded approximately 120 degrees relative to bend (12) to form bend (13). Bend (13) widens the slot within which the magwell of the assault weapon rests.

In use the magwell of an assault weapon rests within and is supported by the "U" shaped channel of lower holster bracket (9) while upper holster bracket (1) securely attaches to the pistol grip of the assault weapon thereby providing two points of contact between the assault weapon and the tactical vest.

Figure 6:
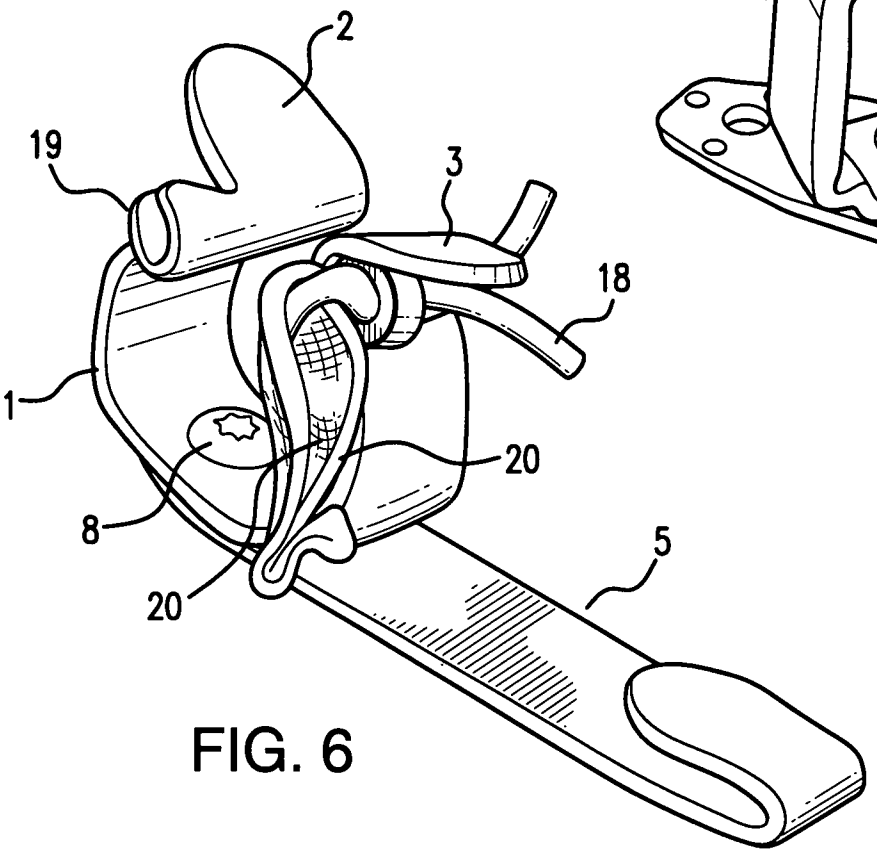
FIG. 6 shows the upper bracket of the instant holster in perspective and separate from the tactical vest.

FIG. 6 shows the structure of FIG. 3 in perspective. Screw (8) can be seen rotatably affixing upper holster bracket (1) to upper moly webbing fastener (5). Because of the rotatable attachment of upper holster bracket (1) to upper moly web fastener (5), the assault weapon has somewhat more freedom to adapt to the different orientations of a user when engaged in combat or unexpected conditions.

Figure 7:
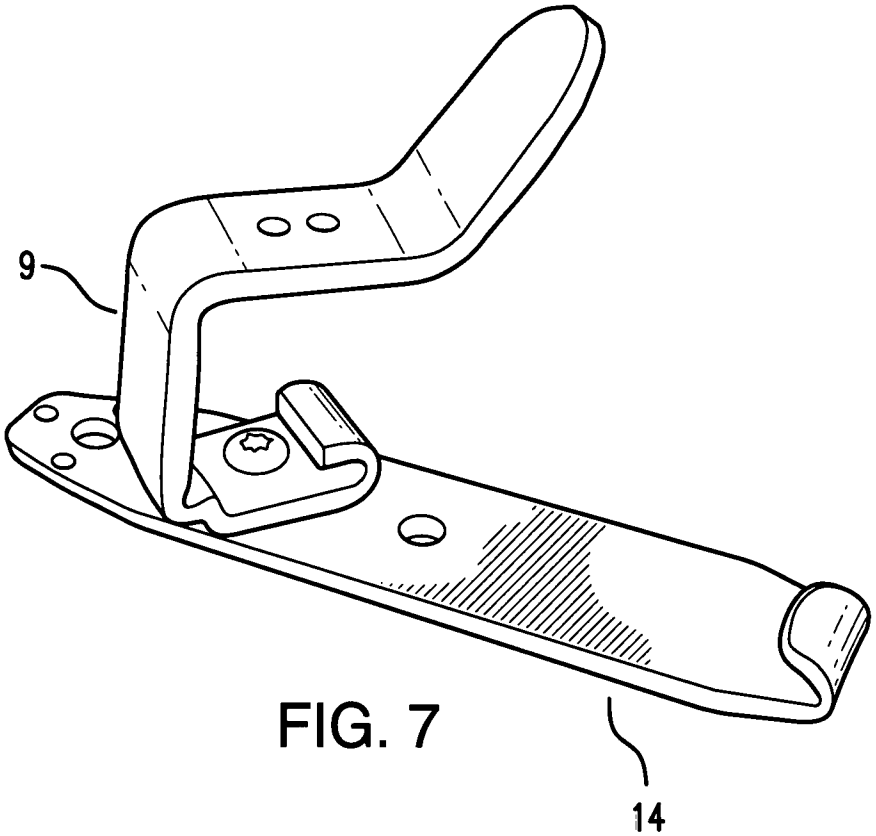
FIG. 7 shows the lower bracket of the instant holster in perspective and separate from the tactical vest.

Referring to FIG. 7 the lower holster bracket (9) is canted relative to lower moly web fastener (14). Canting lower holster bracket (9) assists in maintaining the magwell of the assault weapon securely pointing towards the ground within lower holster bracket (9) when the weapon is stored in the holster. Canting also provides a more secure grip on the magwell of the assault weapon. A canting angle of 10 to 30 degrees is adequate. Canting can be accomplished by securing the lower holster bracket (9) to the lower moly web fastener (14) such that the lower holster bracket (9) can rotate about lower moly web fastener (14), in a manner similar to the attachment of upper holster bracket (1) to upper moly web fastener (5). Alternatively, lower holster bracket (9) and lower moly web fastener (14) can be made from one-piece of thermoplastic and the lower holster bracket (9) permanently canted.

Figures 8, 8A:
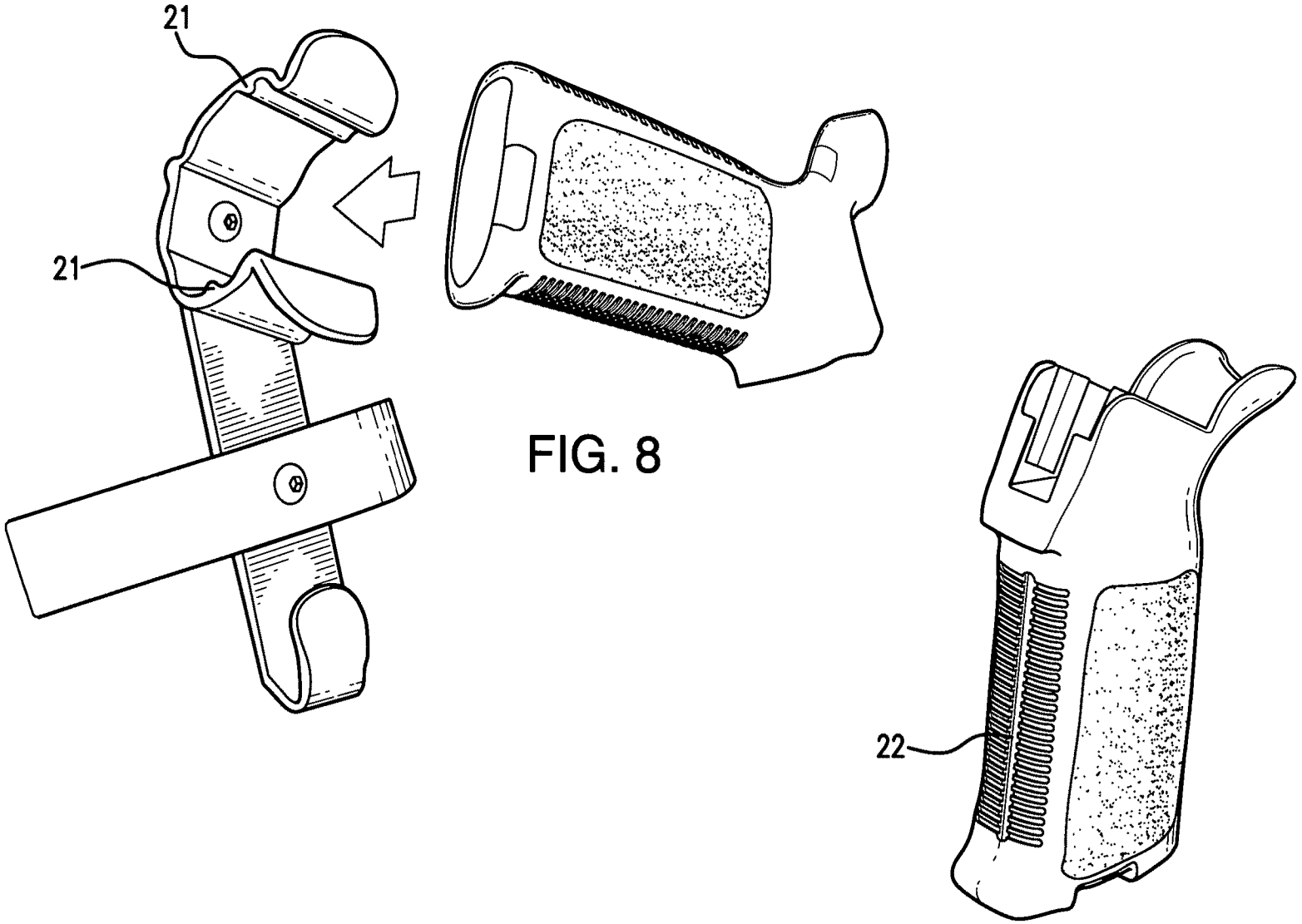
FIG. 8 shows an improved embodiment of the upper holster bracket including detents adapted to engage indentations in the pistol grip of the assault weapon.
FIG. 8A shows the pistol grip of the assault weapon of FIG. 8 in perspective including slots to engage the detents on the upper holster bracket.

FIG. 8 shows a particularly secure U-shaped bracket and pistol grip combination. In this embodiment the upper holster bracket includes at least one transverse elevated ridge (21) located on the inside surface of the U-shaped bracket. The elevated ridge (21) forms an elongated detent adapted to releasably register with and engage a longitudinal corresponding channel (22) on the pistol grip of the assault weapon. Two elevated ridges and two longitudinal channels are preferred for additional security in attaching the pistol grip. The two ridges (21) are positioned on oppositely facing inside surfaces of the U-shaped bracket and the two longitudinal channels (22) are located on the front and rear of the pistol grip, where the front of the pistol grip faces the bore of the weapon and the rear of the pistol grip faces the breach of the weapon.

The pistol grip of FIG. 8 includes longitudinal channel (22) that extends longitudinally along at least one forward or rearward facing outside surface of the pistol grip wherein the pistol grip, best seen in FIG. 8A is adapted to engage the U-shaped holster bracket. The U-shaped holster bracket ridges (21) form a detent that registers in a spring like fashion and engages the longitudinal channels (22) on the pistol grip of the long weapon, thereby securely attaching the pistol grip of the long weapon into the U-shaped bracket.

Figure 9A:
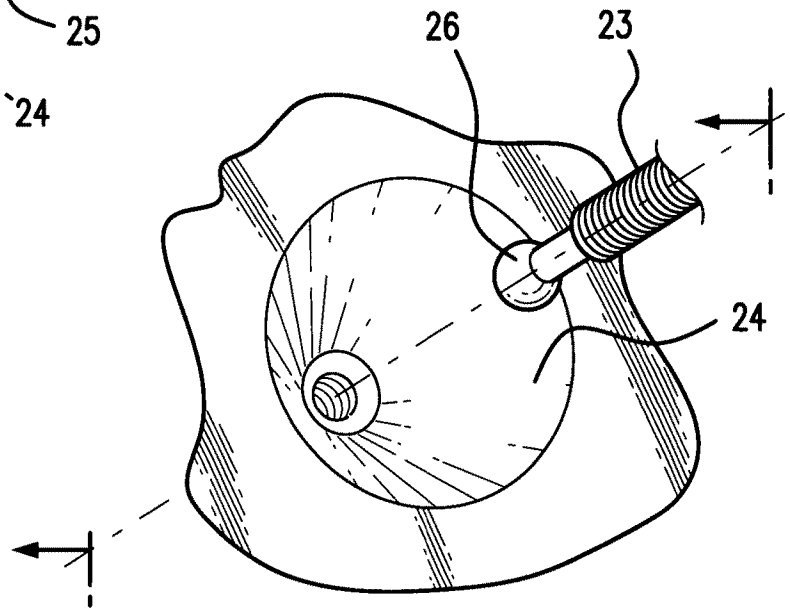
FIG. 9A shows an enlarged section of the post and hole engagement of FIG. 9, as it is found on the pistol grip of an assault weapon.
Figure 9:
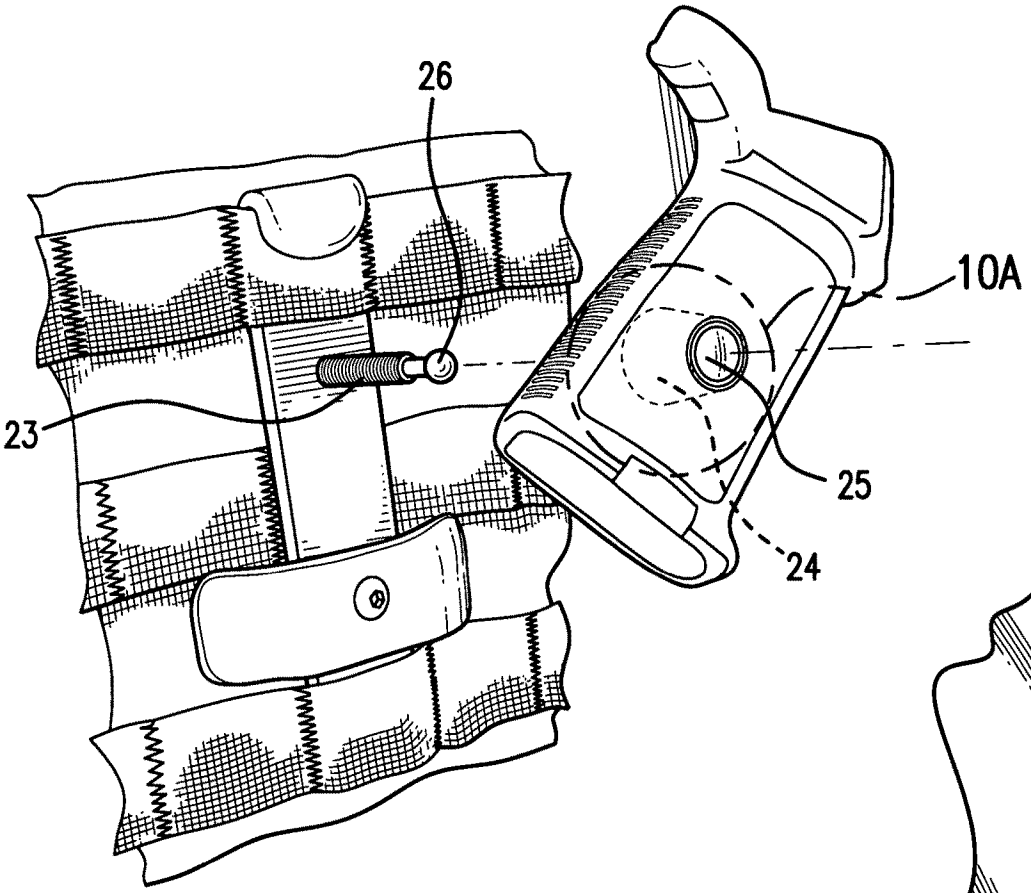
FIG. 9 shows a post adapted to register with and engage a hole through the pistol grip of an assault weapon.

FIGS. 9 and 9A show yet another embodiment of the holster for a weapon having a pistol grip. The holster includes a post (23) adapted to protrude through a hole (24) located on the side of the pistol grip, as seen in FIGS. 9 and 9A. The post (23) aligns with snap element (25) located within the pistol grip of a weapon wherein the post (23) is adapted to engage the weapon securely to the holster, as seen in FIGS. 9 and 9A. The post (23) comprises two ends wherein the proximal end of the post (23) is attached to the holster, as seen in FIG. 9. The post (23) extends outwardly from the holster. The distal end of the post (23) is located at the terminus of the post (23) extending outwardly from the holster and includes a spherical knob member (26) of larger diameter than the post (23); the knob member (26) is adapted to engage the snap element (25) (best seen in FIG. 12) of the pistol grip of the weapon.

The pistol grip includes a conical hole (24) therethrough wherein the hole is adapted to be in register with the post (23) attached to a holster, as seen in FIG. 9. The hole (24) extending through the pistol grip includes a conically shaped recess in the side of the pistol grip facing the holster to aid in registering the pistol grip with the post (23) as seen in FIG. 9A.

Figure 12B:
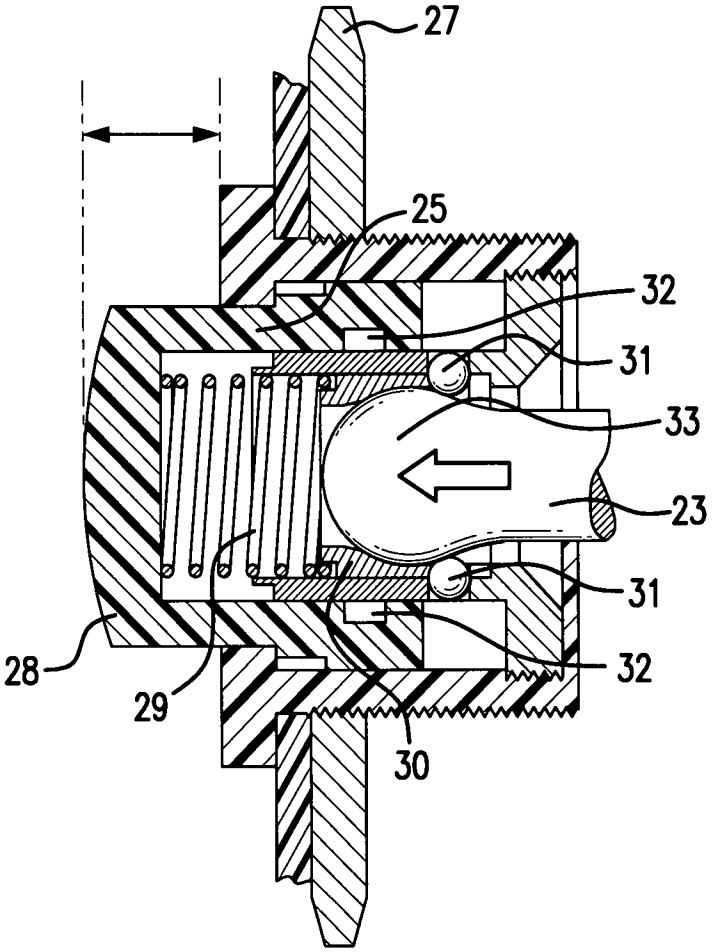
FIG. 12B shows the snap element of FIG. 12A after engagement of the post with the snap element.
Figure 12A:
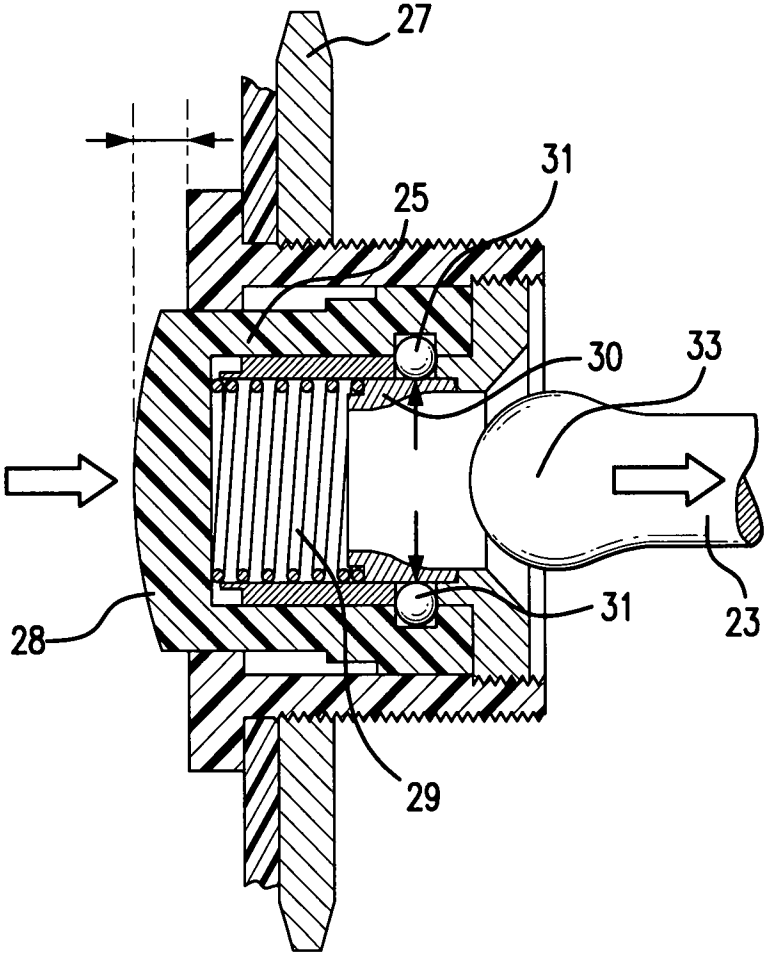
FIG. 12A shows the cross section of a snap element that is adapted to engage the post that secures the pistol grip to the holster, prior to engagement of the post. The snap is embedded in the pistol grip.

FIGS. 12A and 12B show details of the snap element (25) that engages post (23). Snap element (25) is fastened into the side wall (27) of the pistol grip. FIG. 12A shows the post and snap element combination during a disengagement cycle of the post (23) into the snap element (25). Button (28) has been depressed in the direction of the arrow by finger pressure. Spring (29) is compressed forcing collar (30) to push balls (31) into receiving slots (32), thereby allowing hemispherical bulb (33) to extend beyond balls (31). In the preferred embodiment three balls (31) are utilized although one, two, three, or more balls may be used.

FIG. 12B shows details of the snap element (25) and post (23) when the post element (23) is engaged by snap element (25). Button (28) is biased outwardly from the side (27) of the pistol grip by spring (28). Collar (30) has been forced outwardly allowing balls (31) to recede from slots (32) and securely grip hemispherical bulb (33).

Figure 10:
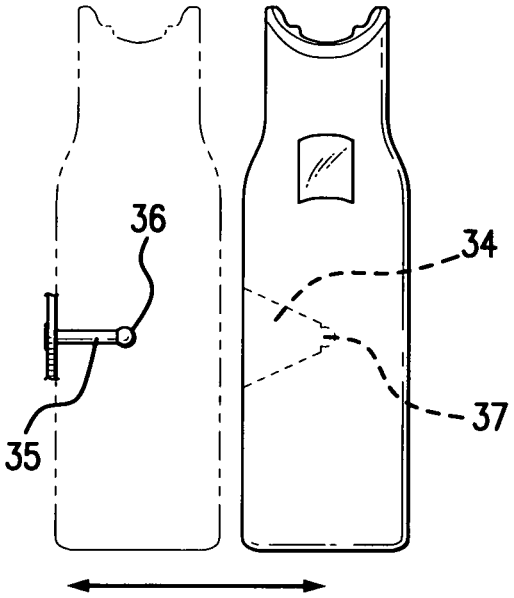
FIG. 10 shows the post and hole combination of FIG. 9 that secures the pistol grip to the holster as seen from the real of the pistol grip.
Figure 11:
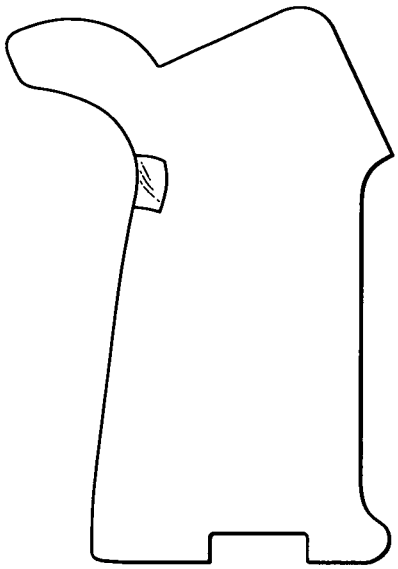
FIG. 11 shows the pistol grip of FIG. 10 as seen from the side of the pistol grip that faces away from the holster.

FIGS. 10 and 11 show another embodiment of the holster for a long weapon. In this species a conical hole (34) is provided in the side of the pistol grip that faces the holster. Post (35) includes a hemispherical bulb (36) on the distal end of the post facing away from the holster. The hemispherical bulb (36) is of larger diameter than post (35) and is adapted to engage a corresponding hole (37) embedded in the bottom of conical hole (36) with an interference fit, thereby securely engaging the pistol grip to the holster. FIG. 11 shows the face of the pistol grip that is located outwardly from the holster. As can be seen, this face is free of any fastening means.

Figure 13:
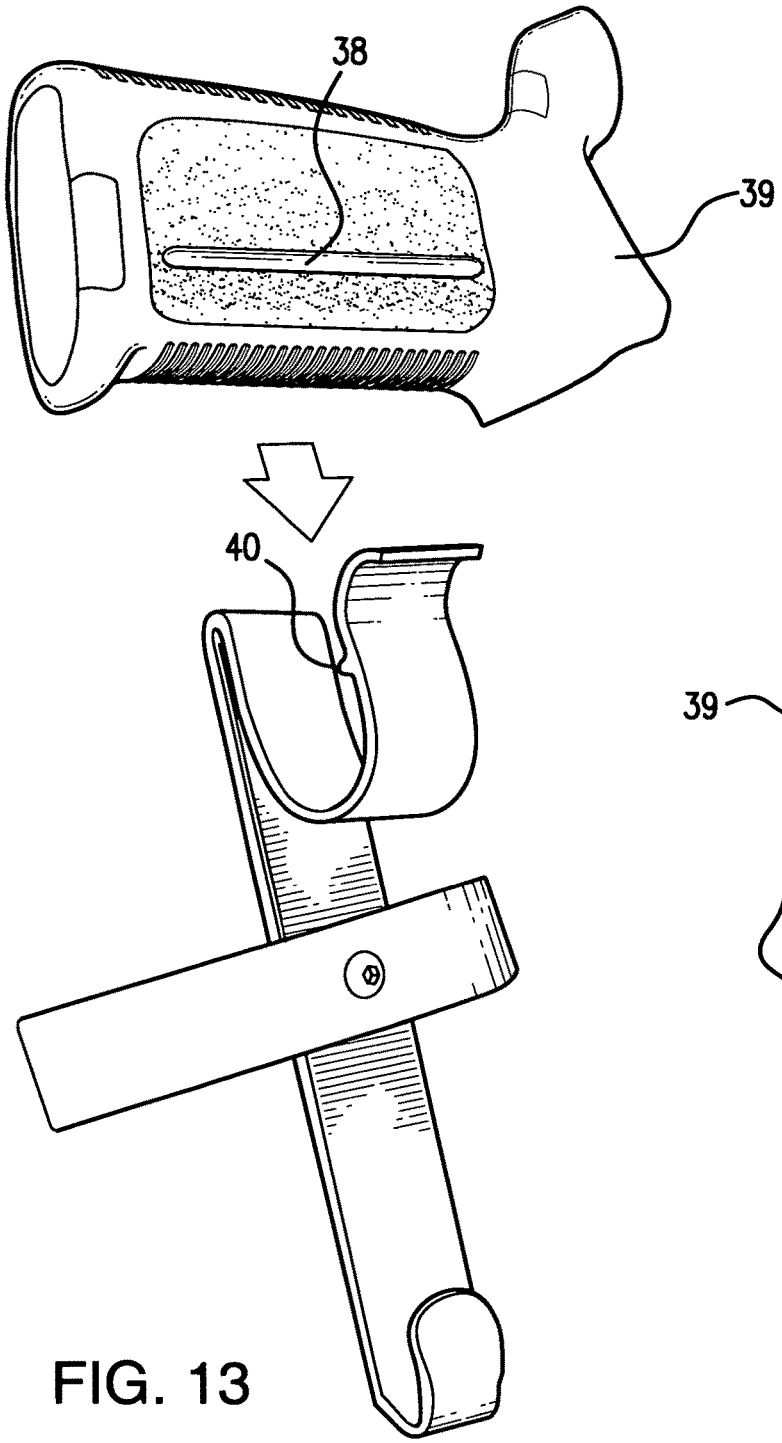
FIGS. 13 and 13A show another embodiment of the upper holster bracket. The pistol grip of FIG. 13 includes elongated channel that extends longitudinally along at least one sidewall of the pistol grip.
Figure 13A:
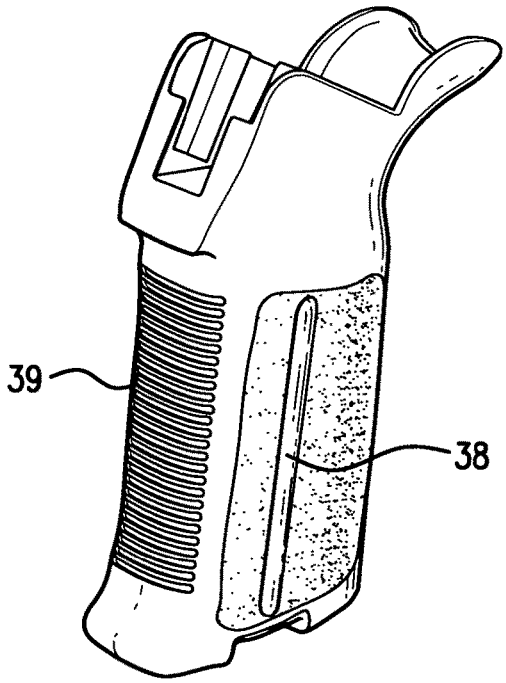

FIGS. 13 and 13A show another embodiment of the upper holster bracket. The pistol grip of FIG. 13 includes elongated channel (38) that extends longitudinally along at least one sidewall of the pistol grip (38). Channel (38) could be provided on both sidewalls of pistol grip (39), that is both the sidewall facing the user and the sidewall facing away from the user. The channels (38) are adapted to engage the U-shaped upper holster bracket. The U-shaped holster bracket includes elongated ridges forming detents (40) on the inside surface of the "U" portion of the upper bracket, best seen in FIG. 13 that register in a spring like fashion and engage the longitudinal channels (38) on the pistol grip of the weapon, thereby securely attaching the pistol grip (39) of the assault into the U-shaped bracket.

Figure 14:
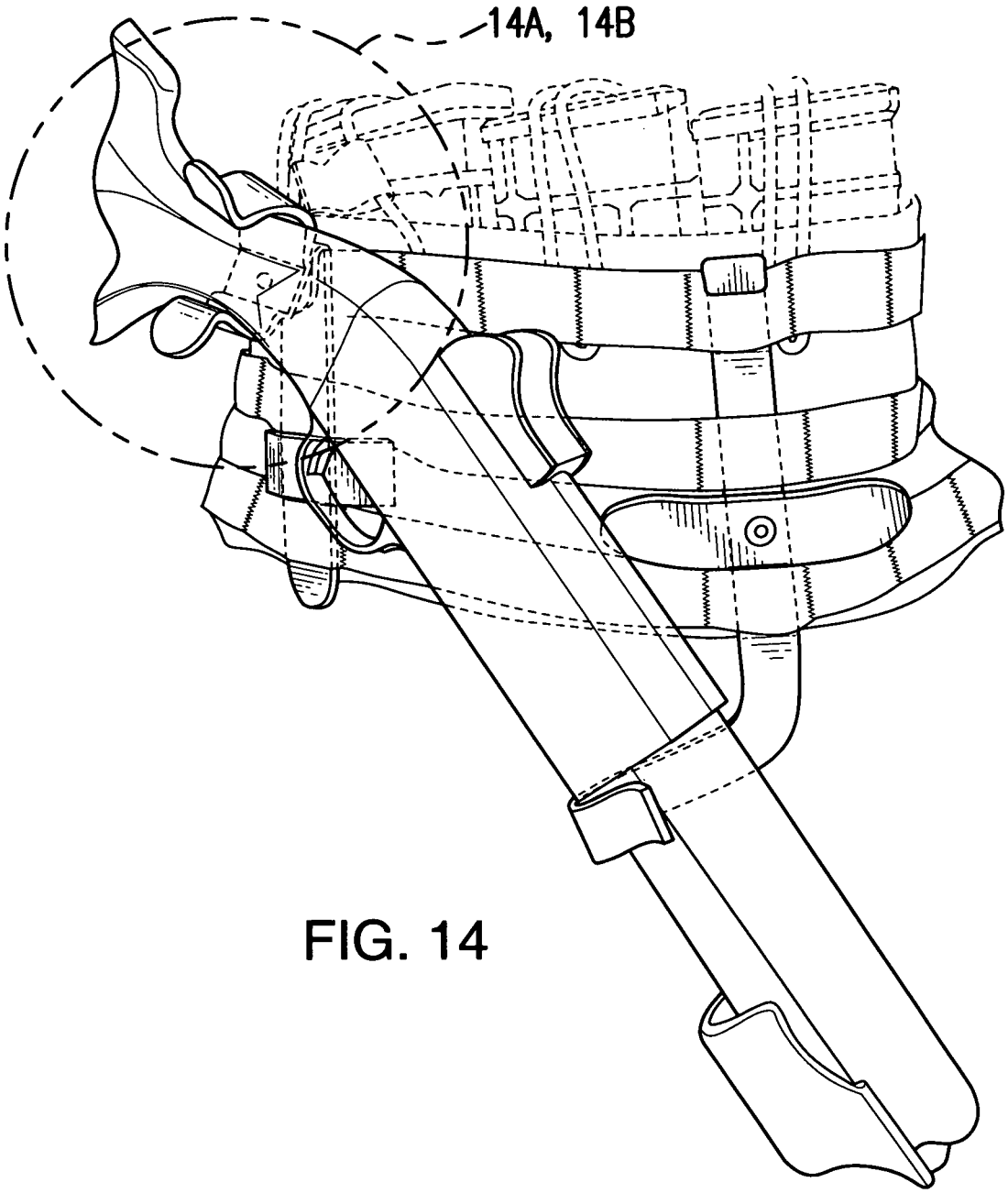
FIG. 14 shows an embodiment of the upper holster bracket where the "U" shaped portion of the upper holster bracket opens outwardly from the user.
Figure 14B:
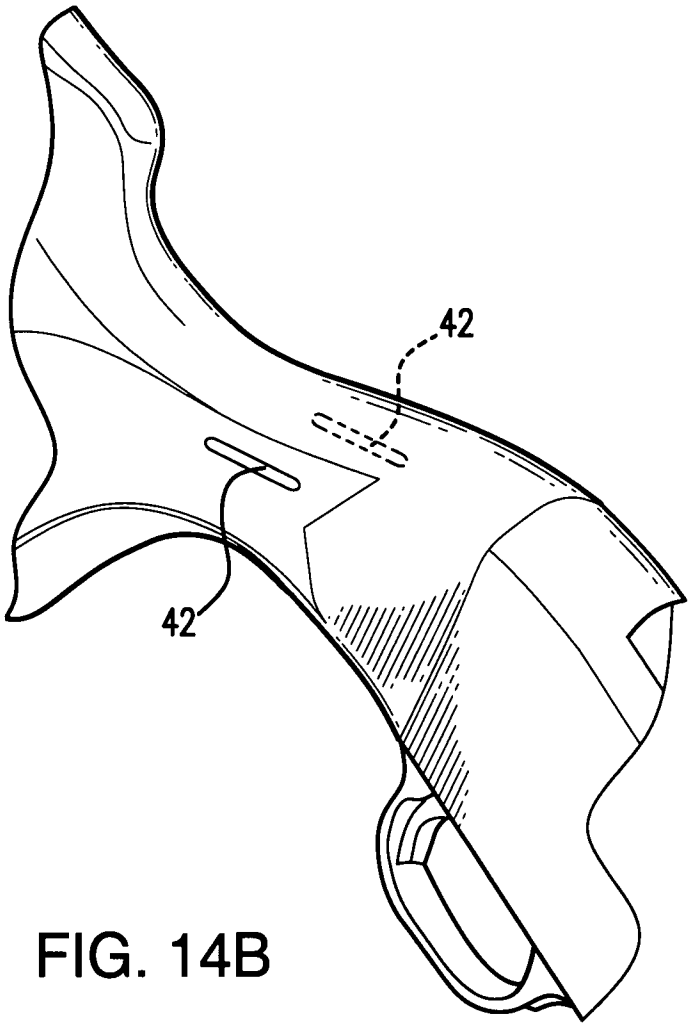
FIG. 14B shows channels on at least one of the inner or outer surfaces of the grip of the weapon adapted to engage a "U" shaped bracket.
Figure 14A:
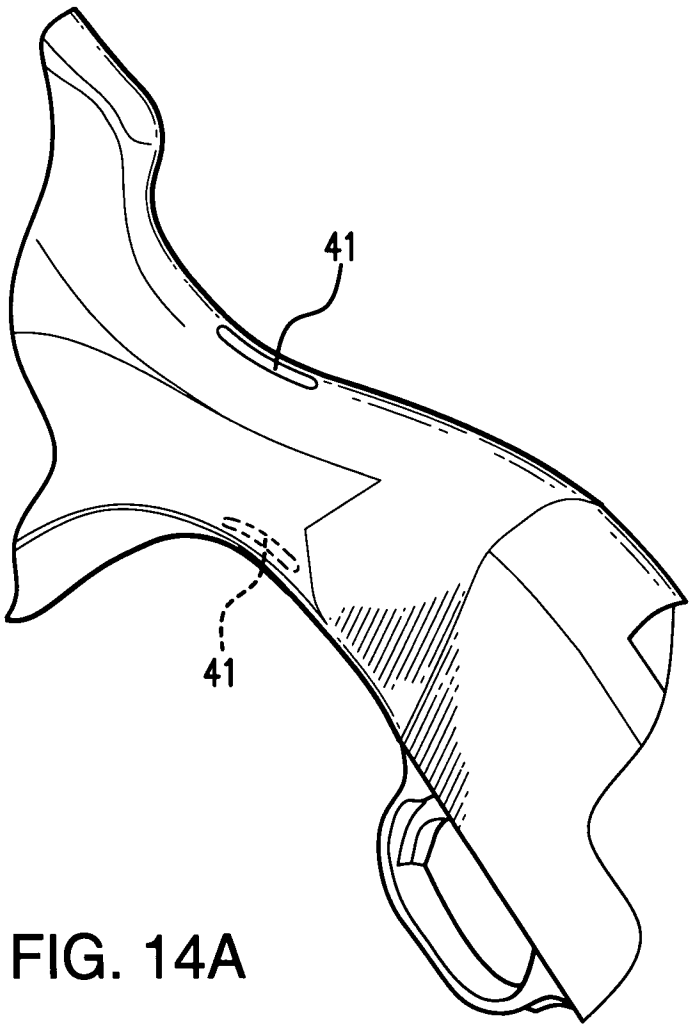
FIG. 14A shows channels on at least one of the upper or lower surfaces of the grip of the weapon adapted to engage a "U" shaped bracket.

FIG. 14 shows an embodiment of the upper holster bracket where the "U" shaped portion of the upper holster bracket opens outwardly from the user. In this orientation the weapon is pulled directly away from the user in order to release the weapon from the holster. When the "U" shaped bracket is oriented to open away from the user in this fashion, detents (40) are provided on the inside surface of the "U" shaped bracket adapted to engage channels on at least one of the upper or lower surfaces of the grip of the weapon, as seen in FIG. 14A. Alternatively the "U" shaped bracket could be oriented to open in a vertically upward direction, as in FIG. 13. When the "U" shaped bracket is oriented to open vertically upward from the user in this fashion, as in FIG. 13, detents (40) are provided on the inside surface of the "U" shaped bracket adapted to engage channels (42) on at least one of the inner or outer surfaces of the grip of the weapon, as seen in FIG. 14B.

The invention claimed is:

1. A holster system for a long weapon comprising:

a "U"-shaped bracket having one or more detents on an inner surface of the "U" shaped bracket; and a long weapon having one or more channels defined in an outer surface of the long weapon;

wherein the one or more detents engage corresponding ones of the one or more channels when the long weapon is inserted into the "U"-shaped bracket, thereby selectively securing the long weapon into the "U"-shaped bracket.

2. The holster system of claim 1, further comprising:

a lower bracket to engage a portion of the long weapon forward of the "U"-shaped bracket.

3. A holster system for a long weapon comprising:

a "U"-shaped bracket having one or more elongated detents on an inner surface of the "U" shaped bracket; and a pistol grip affixed to the long weapon, the pistol grip having one or more elongated channels extending longitudinally along one or more faces of the pistol grip;

wherein the one or more elongated detents engage corresponding ones of the longitudinal channels on the pistol grip when the pistol grip is inserted into the "U"-shaped bracket, thereby selectively securing the pistol grip into the "U"-shaped bracket.

4. The holster system of claim 3, further comprising:

a lower bracket to engage a portion of the long weapon forward of the pistol grip.

* * * * *